US005738134A

United States Patent [19]

Ishizaki et al.

[11] Patent Number: 5,738,134

[45] Date of Patent: Apr. 14, 1998

[54] PRESSURE COMPENSATION VALVE

[75] Inventors: Naoki Ishizaki; Mitsumasa Akashi, both of Tochigi-ken, Japan

[73] Assignee: Komatsu Ltd., Japan

[21] Appl. No.: 765,193

[22] PCT Filed: Jul. 11, 1995

[86] PCT No.: PCT/JP95/01378

§ 371 Date: Jan. 3, 1997

§ 102(e) Date: Jan. 3, 1997

[87] PCT Pub. No.: WO96/01952

PCT Pub. Date: Jan. 25, 1996

[30] Foreign Application Priority Data

Jul. 12, 1994 [JP] Japan ..... 6-159902

[51] Int. Cl.[6] ..... F15B 11/05

[52] U.S. Cl. ..... 137/118.07; 60/452; 91/446; 137/596

[58] Field of Search ..... 60/427, 452; 91/446, 91/518; 137/596, 118.07

[56] References Cited

FOREIGN PATENT DOCUMENTS 60-11706 1/1985 Japan .

2-18903 2/1990 Japan .

4-244605 9/1992 Japan .

*Primary Examiner*—Gerald A. Michalsky

*Attorney, Agent, or Firm*—Ronald P. Kananen

[57] ABSTRACT

A pressure compensation valve has a check valve portion with a check valve bore with an inlet port and an outlet port in a valve body, a valve in the check valve bore for establishing and blocking communication between the inlet port and the outlet port, a pressure reduction valve portion constructed by forming a pressure reducing valve bore having a first port, a second port and a third port and being coaxial with the check valve bore in the valve body, a spring-biased spool in the pressure reduction valve bore to define a first pressure chamber communicating with the first port and a second pressure chamber communicating with the third port at both sides, making the second port communicate with the third port by a pressure of the first pressure chamber, and blocking communication between the second port and the third port by the pressure in the second pressure chamber.

3 Claims, 3 Drawing Sheets

PRESSURE COMPENSATION VALVE

TECHNICAL FIELD

The present invention relates to a pressure compensation valve to be employed in a hydraulic circuit for distributing in flow rate for supplying a discharged pressurized fluid of one or more hydraulic pumps in a constructional machine to a plurality of actuators.

BACKGROUND ART

When a discharged pressurized fluid of one hydraulic pump is supplied to a plurality of actuators, the pressurized fluid tends to be supplied only to the actuator having lower load pressure. As a solution for this, a hydraulic circuit shown in Japanese Unexamined Patent Publication (Kokai) No. Sho 60-11706, for example, has been known. This is a hydraulic circuit, in which a pressure compensation valves are provided at respective inlet sides of direction control valves connected to respective actuators, respective pressure compensation valves are set at the highest load pressure among load pressures of all of the actuators for distributing in flow rate for supplying the discharged pressurized fluid of the hydraulic pump to a plurality of actuators having different load pressures.

As such pressure compensation valve for a hydraulic circuit, there is one disclosed in Japanese Unexamined Patent Publication (Kokai) No. Hei 4-244605 has been known, for example.

As shown in FIG. 1, this is constructed by providing a check valve bore 1*a* having an inlet port 2 and an outlet port 3 in a valve body, and slidably disposing a valve 4 within the check valve bore 1*a* for establishing and blocking communication between the inlet port 2 and the outlet port 3, for forming a check valve portion. Also, a pressure reduction valve bore 1*b* with a first port 6, a second port 8 and a third port 9 is provided in the valve body. A spool 11 is slidably disposed within the pressure reduction valve bore 1*b* for defining a first pressure chamber 7 communicating with the first port 6 and a second pressure chamber communicating with the third port 9 at both end sides so that the spool 11 is shifted toward the right by the pressure within the first pressure chamber 7 to establish communication between the second port 8 and the third port 9 and shifted toward the left by the pressure within the second pressure chamber 10 for blocking communication between the second port 8 and the third port 9. It should be noted that, the spool 11 is biased in a direction for blocking communication between the second port 8 and the third port 8 by a spring 13 to contact with the valve 4. Then, with these components, a pressure compensation valve is constructed.

With such pressure compensation valve, when the pressure in the first pressure chamber 7 is higher than the pressure in the second pressure chamber 10, the spool 11 is shifted toward the right away from the valve 4. The valve 4 is then placed at a position where the pressure in the inlet port 2 and the pressure in the outlet port 3 becomes equal to each other. On the other hand, as a result, the pressure in the first pressure chamber 7 and the pressure in the second pressure chamber 10 becomes equal to each other. On the other hand, when the pressure in the first pressure chamber 7 is lower than the pressure in the second pressure chamber 10, the spool 11 is shifted toward the left. Thus, the valve 4 is pushed in a direction for blocking communication by the spool 11 so that the pressure of the outlet port 3 becomes higher than the pressure in the inlet port 2 to the extent corresponding to a pressure difference between the second pressure chamber 10 and the first pressure chamber 7.

With such construction, by connecting the outlet port 3 to a pump port 15 of a direction control valve 14, connecting the first port 6 to an outlet port 16 of the direction control valve 14 to introduce an own load pressure into the first pressure chamber 7, connecting the third port 9 to a load pressure detecting line 17 for introducing a control pressure $P_{LS}$ into the second pressure chamber 10, and making a discharge passage 19 of the hydraulic pump 18 communicate with the inlet port 2 and the second port 8, a pump discharge pressure $P_0$ can be output to the output port 3 as an output pressure $P_2$ while reducing the pressure to the extent corresponding to a pressure difference ($P_{LS}$–$P_1$) between the control pressure $P_{LS}$ and the own load pressure $P_1$.

For example, assuming that $P_0$=120 kg/cm$^2$, and $P_{LS}$ and $P_1$ are 100 kg/cm$^2$, the output pressure $P_2$ becomes 120 kg/cm$^2$. On the other hand, when $P_0$=120 kg/cm$^2$, $P_1$=10 kg/cm$^2$ and $P_{LS}$=100 kg/cm$^2$, the output pressure $P_2$ becomes 30 Kg/cm$^2$.

On the other hand, in the pressure compensation valve, in order to vary the pressure difference between the output pressure $P_2$ (a pressure at an upstream side of a meter-in of the direction control valve 14) and the load pressure $P_1$ (a pressure at a downstream side of the meter-in of the direction control valve 14), namely to vary pressure compensation characteristics, it becomes necessary to vary diameter of the valve 4 or the spool 11.

A relationship between the pressures $P_0$, $P_1$ and $P_{LS}$ as set forth above is in a relationship where the valve 4 and the spool 11 have the same diameter. In order to make the pressures $P_0$ and $P_{LS}$ fixed and to make a pressure difference ($P_2$–$P_1$) of the pressures $P_2$ and $P_1$ smaller, a diameter of the valve 4 may be made smaller to make a force acting in the direction to establish communication smaller, or in the alternative, a diameter of the spool 11 is made greater to make a force to push the valve 4 through the spool 11 in the direction for closing the valve 4 greater, to lower the output pressure $P_2$. On the other hand, in order to make the pressure difference ($P_2$–$P_1$) greater, conversely to the above, the diameter of the valve 4 is made greater or the diameter of the spool 11 is made smaller.

However, when the diameter of the valve 4 or the diameter of the spool 11 is varied, it inherently requires to vary a diameter of the check valve bore 1*a* or the pressure reduction valve bore 1*b* of the valve body 1. As a result, the valve body 1, the valve 4 and the spool 11 and so forth must be exchanged, raising the cost.

Therefore, the present invention has been worked out in view of the problems set forth above. It is an object of the present invention to provide a pressure compensation valve which does not require exchanging of a valve body, a valve and a spool even when a pressure compensation characteristics is varied, and can lower a cost.

In order to accomplish the above-mentioned object, according to one aspect of the invention, a pressure compensation valve comprises:

a check valve portion constructed by forming a check valve bore with an inlet port and an outlet port in a valve body, and slidably disposing a valve in the check valve bore for establishing and blocking communication between the inlet port and the outlet port;

a pressure reduction valve portion constructed by forming a pressure reducing valve bore having a first port, a second port and a third port and being coaxial with the check valve bore in the valve body, slidably disposing a spool in the pressure reduction valve bore to define a first pressure chamber communicating with the first port and a second pressure chamber communicating with the third port at both sides, making the second port communicate with the third port by a pressure of the first pressure chamber, and blocking communication between the second port and the third port by the pressure in the second pressure chamber;

the spool being pushed in a direction for blocking communication between the second port and the third port by a spring to cause pressure contact with the valve to push the valve in valve closing direction, wherein the pressure receiving valve further comprising:

a pressure receiving chamber communicating with the second port via an orifice and pushing the spool in a direction for blocking communication by the pressure therein;

a fluid passage for establishing communication between the pressure receiving chamber and the outlet port when the valve is in a communicating position, and pressure adjusting means for adjustably setting a pressure in the pressure receiving chamber.

With the construction set forth above, the pressure compensation characteristics can be varied by varying the pressure within the pressure receiving chamber by the pressure adjusting means. Thus, it becomes unnecessary to exchange the valve body, the valve, spool and so forth, and thus a cost can be lowered.

It should be noted that, in the construction set forth above, the pressure adjusting means preferably is constructed with a fixed path area orifice provided at an upstream side of the fluid passage and a variable relief valve provided at a downstream side.

Also, the pressure adjusting means may be a variable orifice.

BRIEF DESCRIPTION OF THE DRAWINGS

The present invention will be understood more fully from the detailed description given herebelow and from the accompanying drawings of the preferred embodiment of the invention, which, however, should not be taken to be limited to the present invention, but are for explanation and understanding only.

In the drawings.

BEST MODE FOR IMPLEMENTING THE INVENTION

The preferred embodiments of a pressure compensation valve according to the present invention will be discussed hereinafter with reference to the accompanying drawings.

Figure 1:
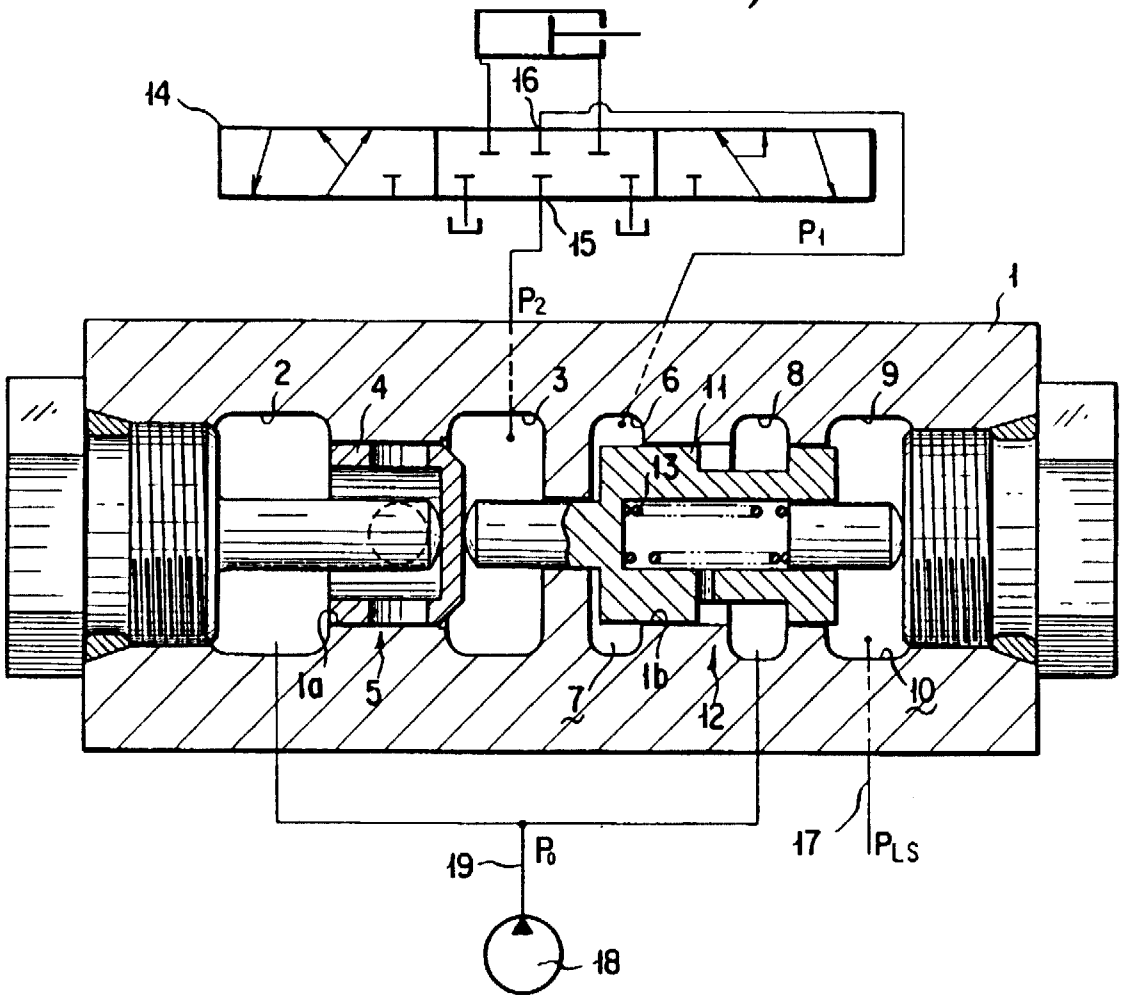
FIG. 1 (Prior Art)
FIG. 1 is a section of the conventional pressure compensation valve.
Figure 2:
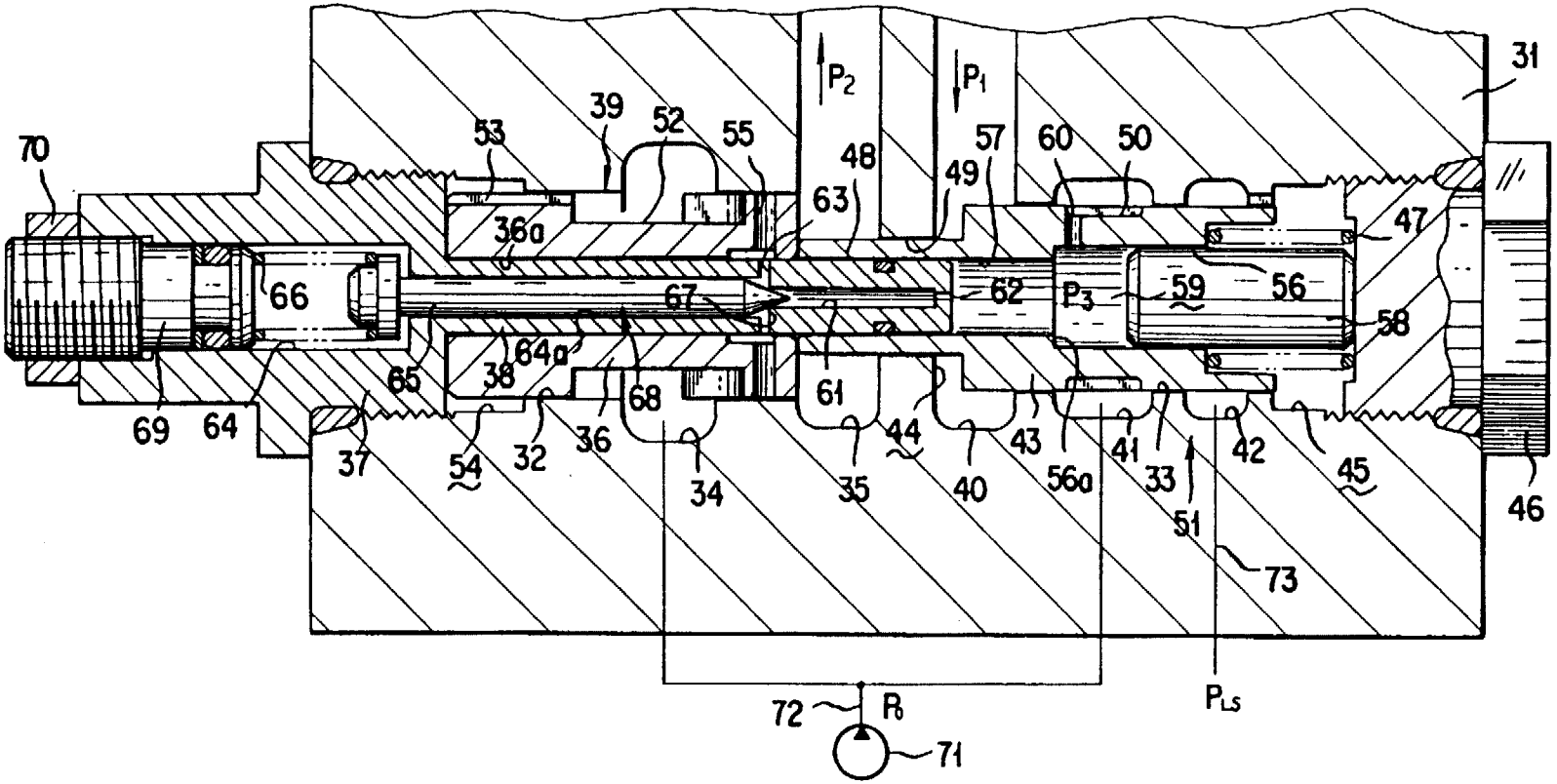
FIG. 2 is a section of the first embodiment of a pressure compensation valve according to the present invention.

FIG. 2 is a section of the first embodiment of a pressure compensation valve according to the present invention. As shown in FIG. 2, a check valve bore 32 and a pressure reduction valve bore 33 are formed coaxially in a mutually opposite relationship, in a valve body 31. The check valve bore 32 is formed with an inlet port 34 and an outlet port 35. A valve 36 is slidably disposed within the check valve bore 32. The valve 36 is slidable along a rod portion 38 by engaging an axial bore **36*a* thereof with the axially extending rod portion 38 provided on a plug 37, and is restricted to shift toward the left beyond a position as illustrated by the plug 37 threadingly engaged to the left end of the check valve bore 32**.

On the pressure reduction valve bore 38, first, second and third ports 40, 41 and 42 are formed. In the pressure reduction valve bore 33, a spool 43 is slidably disposed for defining a first pressure chamber 44 opening to the first port 40 and a second pressure chamber 45 to be established and blocking communication with respect to the third port 42 at both sides thereof. The spool 43 is pushed toward the left by a spring 47 provided between a right side plug 46. As a result, a push rod 48 formed integrally with the spool 43 is projected through a through hole 49 to make the valve 36 contact with the plug 37, and in conjunction therewith, block communication between the first, second and third ports 40, 41 and 42. On the other hand, when the spool 43 is slidingly shifted toward the right by the pressure in the first pressure chamber 44, communication between the second port 41 and the third port 43 is established via a cut-out 50. By these components, the pressure reduction valve portion 51 is formed.

Furthermore, a smaller diameter portion 52 is formed on the valve 36. The smaller diameter portion 52 communicates with a pressure receiving chamber 54 through a slit 53. On the other hand, a larger diameter portion in the vicinity of the outlet port is formed with a radially extending aperture 55 opening to the axial bore **36*a*. When the valve 36 is pushed toward the right, the aperture 55 communicates with the outlet port 35**.

On the other hand, an axial bore 56 is formed in the spool 43. A bottom portion **56*a* of the axial bore 56 is formed with a small diameter conduit 57 extending through the push rod 48. Also, a piston 58 is disposed in the axial bore 56 to define a pressure receiving chamber 59. The pressure receiving chamber 59 communicates with the second port 41 via an orifice 60 and the cut-out 50**.

A tip end of the rod portion 38 is engaged with the conduit 57 of the spool 43. In the vicinity of the tip end of the rod portion 38, an axial bore 61 is formed. One end of the axial bore 61 communicates with the pressure receiving chamber 59 via a fixed path area orifice 62. The other end of the axial bore 61 communicates with the aperture 55 via a conduit 63. Namely, the axial bore 61, the conduit 57 and the conduit 55 forms a fluid path making the pressure receiving chamber 59 communicate with the outlet port 35.

On the plug 37, a large diameter axial bore 64 and a small diameter axial bore **64*a* continuous to the large diameter axial bore 64 are formed. Within both axial bores 64 and 64*a*, a valve 65 is slidably disposed. The valve 65 is biased by a spring 66 so that a cone-shaped surface 67 abuts onto an opening edge at the other end of the axial bore 61 under pressure to construct a relief valve 68 blocking communication between the axial bore 61 and the conduit 63. Then, by tightening and loosening a spring seat 69 threadingly engaged to the bore 64 of the plug 37, a mounting load of the spring 68 is varied to arbitrarily adjust a set pressure of the relief valve 68. Namely, the relief valve 68 is constructed as a set pressure variable relief valve. It should be noted that numeral 70** denotes a lock nut.

Furthermore, the inlet port 34 and the second port 41 are connected to a discharge passage 72 of a hydraulic pump 71. The outlet port 35 is connected to the upstream side of the meter-in of the not shown direction control valve. The first port 40 is connected to the downstream side of the meter-in of the direction control valve. The third port 42 is connected to a control pressure introducing passage 73.

Next, an operation of the shown embodiment will be discussed.

While the basic operation is the same as the example of the prior art, the spool 43 is pushed toward the left by action of a pressure $P_3$ of the pressure receiving chamber 59 on the bottom portion 56*a* of the axial bore (stepped portion between the axial bore 56*a* and the axial bore 57). By this, the valve 36 is pushed in the closing direction. This point is differentiated from the prior art. Namely, by variation of the pressure $P_3$ of the pressure receiving chamber 59, the output pressure $P_2$ of the check valve 39 is varied.

The pressure $P_3$ of the pressure receiving chamber 59 is determined by the orifice 60, the fixed path area orifice 62 and valve opening pressure (set pressure) of the relief valve 68.

Concretely, the pressure at a downstream side of the fixed path area orifice 62 becomes the valve opening pressure of the relief valve 68. The pump discharged pressurized fluid flowing into the second port 41 flows to the outlet port 35 via the orifice 60, the fixed path area orifice 62, the axial bore 61, the conduit 63 and the conduit 55. Therefore, the pressure $P_3$ of the pressure receiving chamber 59 becomes a pressure corresponding to the diameter of the orifice 60, the diameter of the fixed path area orifice 62 and a valve opening pressure of the relief valve 68. By varying the valve opening pressure of the relief valve 68, the pressure $P_3$ in the pressure receiving chamber 59 can be varied.

Namely, the relief valve 68 serves as a pressure adjusting means for adjusting the pressure $P_3$ of the pressure receiving chamber 59.

Accordingly, by adjusting the valve opening pressure of the relief valve 68 by tightening and loosening the spring seat 69, the pressure $P_3$ in the pressure receiving chamber 59 is varied. By this, the force to push the valve 36 by the spool 43 in a closing direction is increased and decreased to vary the output pressure $P_2$ of the pressure reduction valve portion 39. Thus, the pressure difference $(P_2-P_1)$ of the output pressure $P_2$ and the load pressure $P_1$ as the pressure compensation characteristics, can be varied.

For example, when the valve opening pressure of the relief valve 68 is set at a low pressure, the pressure $P_3$ in the pressure receiving chamber 59 becomes low pressure to make the force push the valve 36 in the closing direction by the spool 43 to make the output pressure $P_2$ higher. Thus, the pressure difference $(P_2-P_1)$ becomes greater to cause pressurized fluid to easily leak.

Figure 3:
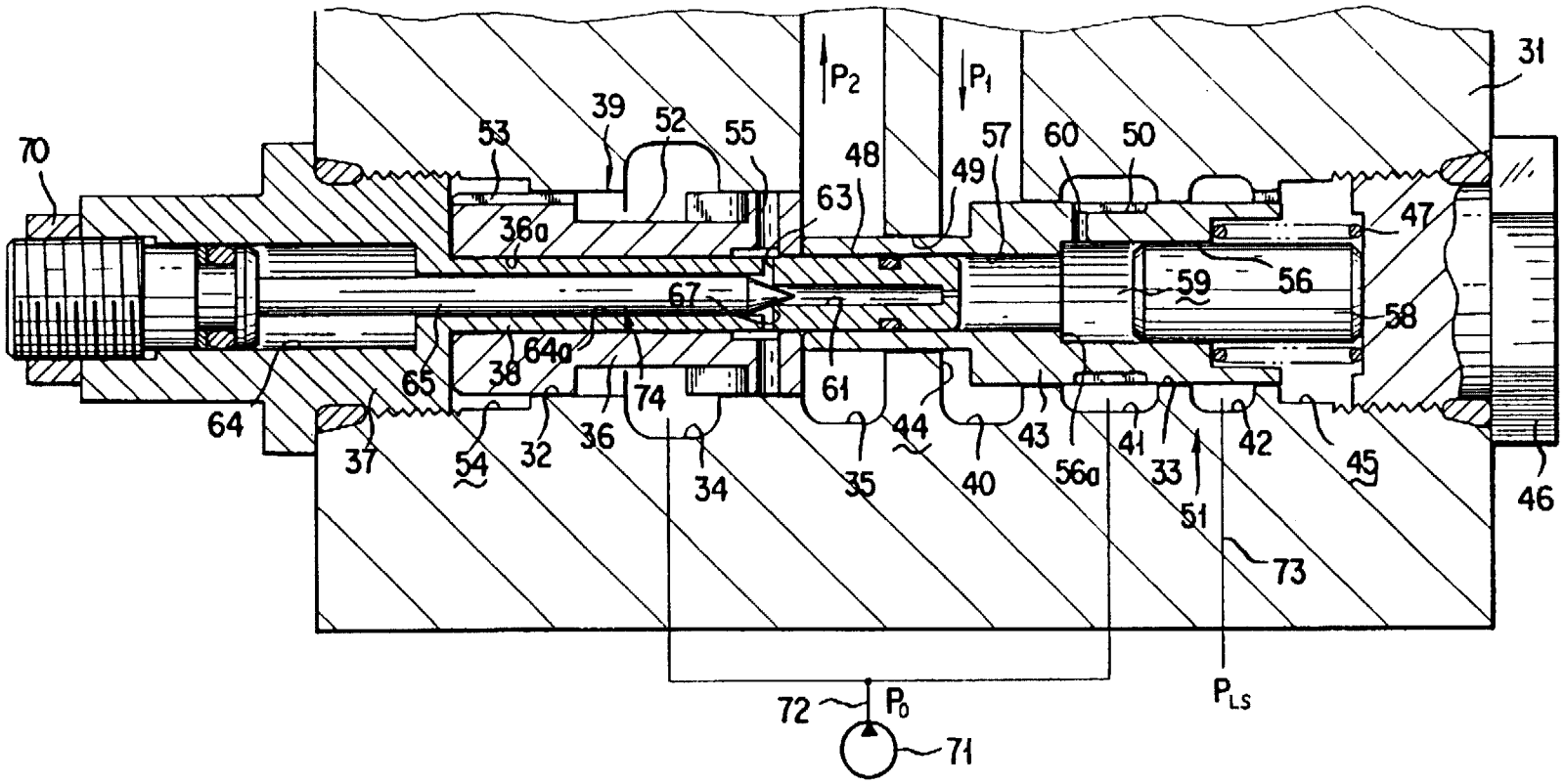
FIG. 3 is a section of the second embodiment of a pressure compensation valve according to the invention.

FIG. 3 shows a section of the second embodiment. In this embodiment, the valve 65 is threadingly engaged with the bore 64 of the plug 37, and by tightening and loosening the valve 65, the gap between the cone-shaped surface 67 and the other opening edge of the axial bore 61 is adjusted. Thus, variable orifice 72 is constructed.

With such construction, the pressure $P_3$ in the pressure receiving chamber 59 can be varied by adjusting the path area of the variable orifice 74 (cross sectional area of the gap between the cone surface 67 of the valve 65 and the other end opening edge of the axial bore 61) without providing the fixed path area orifice 62. Namely, the variable orifice 74 serves as the pressure adjusting means for adjusting the pressure $P_3$ of the pressure receiving chamber 59.

Thus, by adjusting a flow path area of the variable orifice 74 by tightening and loosening the valve 65, a pressure $P_3$ in the pressure receiving chamber 59 is varied. By this, the force to push the valve 36 in the closing direction by the spool 43 is increased and decreased to vary the output pressure $P_2$ of the pressure reduction valve portion 39 to vary the pressure difference of the output pressure $P_2$ and the load pressure $P_1$ as the pressure compensation characteristics, can be varied.

As set forth above, since the pressure adjusting valve according to the present invention can vary the pressure compensation characteristics by varying the pressure in the pressure receiving chamber by pressure adjusting means, it becomes unnecessary to exchange the valve body 31, the valve 36, the spool 43 and so forth to make the cost lower.

Although the invention has been illustrated and described with respect to an exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

We claim:

1. A pressure compensation valve comprising:

a check valve portion constructed by forming a check valve bore with an inlet port and an outlet port in a valve body, and slidably disposing a valve in said check valve bore for establishing and blocking communication between said inlet port and said outlet port;

a pressure reduction valve portion constructed by forming a pressure reducing valve bore having a first port, a second port and a third port and being coaxial with said check valve bore in said valve body, slidably disposing a spool in said pressure reduction valve bore to define a first pressure chamber communicating with said first port and a second pressure chamber communicating with said third port at both sides, making said second port communicate with said third port by a pressure of said first pressure chamber, and blocking communication between said second port and said third port by the pressure in said second pressure chamber;

said spool being pushed in a direction for blocking communication between said second port and said third port by a spring to cause pressure contact with said valve to push said valve in a valve closing direction, wherein said pressure receiving valve further comprising:

a pressure receiving chamber communicating with said second port via an orifice and pushing said spool in a direction for blocking communication by the pressure therein;

a fluid passage for establishing communication between said pressure receiving chamber and said outlet port when said valve is in a communicating position, and pressure adjusting means for adjustably setting a pressure in said pressure receiving chamber.

2. A pressure compensation valve as set forth in claim 1, wherein said pressure adjusting means is constructed with a fixed path area orifice provided at an upstream side of said fluid passage and a variable relief valve provided at a downstream side.

3. A pressure compensation valve as set forth in claim 1, wherein said pressure adjusting means is a variable orifice.

* * * * *